US008133036B2

(12) United States Patent
Brisland

(10) Patent No.: US 8,133,036 B2
(45) Date of Patent: Mar. 13, 2012

(54) FLUID POWERED MOTOR

(75) Inventor: Michael John Brisland, Sheffield (GB); Margaret Lavina Brisland, legal representative, Sheffield (GB)

(73) Assignee: Hydrodrives Technologies Inc. (CA)

( * ) Notice: Subject to any disclaimer, the term of this patent is extended or adjusted under 35 U.S.C. 154(b) by 374 days.

(21) Appl. No.: 11/913,648

(22) PCT Filed: May 9, 2006

(86) PCT No.: PCT/GB2006/001659

§ 371 (c)(1),
(2), (4) Date: May 27, 2008

(87) PCT Pub. No.: WO2006/120407

PCT Pub. Date: Nov. 16, 2006

(65) Prior Publication Data

US 2009/0041591 A1 Feb. 12, 2009

(30) Foreign Application Priority Data

May 12, 2005 (GB) ..... 0509787.8

(51) Int. Cl.
*F04B 27/08* (2006.01)
*F01B 13/04* (2006.01)

(52) U.S. Cl. ..... 417/269; 74/56; 91/196; 91/499; 92/57; 92/71

(58) Field of Classification Search ..... 417/269, 417/461, 204, 237, 264, 375, 399, 400, 403, 417/405, 408; 74/60, 64, 55, 56; 91/474, 91/499, 196, 507; 92/12.2, 57, 71, 54, 12.1
See application file for complete search history.

(56) References Cited

U.S. PATENT DOCUMENTS 3,274,896 A * 9/1966 Mikko Terho ..... 91/196
(Continued)

FOREIGN PATENT DOCUMENTS

DE 31 20 334 A1 12/1982
(Continued)

*Primary Examiner* — Devon C Kramer
*Assistant Examiner* — Leonard Weinstein
(74) *Attorney, Agent, or Firm* — Clark Hill PLC

(57) ABSTRACT

A low pressure fluid powered motor or pump comprises a non-rotatable cover (k); an undulating lobe cam track (e) attached to the cover (k) and defining multiple crests and troughs; a rotatable cylinder block (c); at least three reciprocating pistons (d) each housed within a bore of the cylinder block (c) and each providing at one end a crown (d1), and at the other end a spherical seating cup (d2); a ball (f), adapted to engage with the cam track (e); a non-rotatable manifold block (n) incorporating a plurality of ports (s), each being radially disposed at equal intervals in an end face of the manifold block adjacent the pistons (d), with the ports (s) linked to galleries connected to a higher pressure delivery circuit, and a lower pressure return circuit, with the angular arrangement of the ports (s) being such that the higher pressure is supplied to the crown (d1) of each piston (d) only while the piston (d) is moving from a crest to a trough of the cam track (e), with a switch to the lower fluid pressure circuit as continued rotation of the cylinder block (c) moves a piston (d) from a trough to a crest; an output/input shaft (a) connected to the cylinder block (c); and a rotary shaft-mounted, spring biased commutation, multi-ported face plate (i) interposed between the cylinder block and the manifold block.

16 Claims, 4 Drawing Sheets

U.S. PATENT DOCUMENTS

| | | | | | |
|---|---|---|---|---|---|
| 3,585,901 | A | | 6/1971 | Moon, Jr. et al. | |
| 3,776,102 | A | * | 12/1973 | Katayama | 91/483 |
| 4,418,656 | A | * | 12/1983 | Stanton | 123/56.9 |
| 4,598,627 | A | * | 7/1986 | Brisland | 91/477 |
| 5,423,183 | A | * | 6/1995 | Folsom | 60/492 |
| 5,685,215 | A | * | 11/1997 | Jepsen et al. | 92/71 |
| 5,813,315 | A | * | 9/1998 | Kristensen et al. | 92/71 |
| 6,672,849 | B1 | * | 1/2004 | Martindale et al. | 417/572 |
| 2005/0175471 | A1 | * | 8/2005 | Kadlicko | 417/269 |

FOREIGN PATENT DOCUMENTS

| | | |
|---|---|---|
| GB | 1 285 698 | 8/1972 |

* cited by examiner

Figure 4
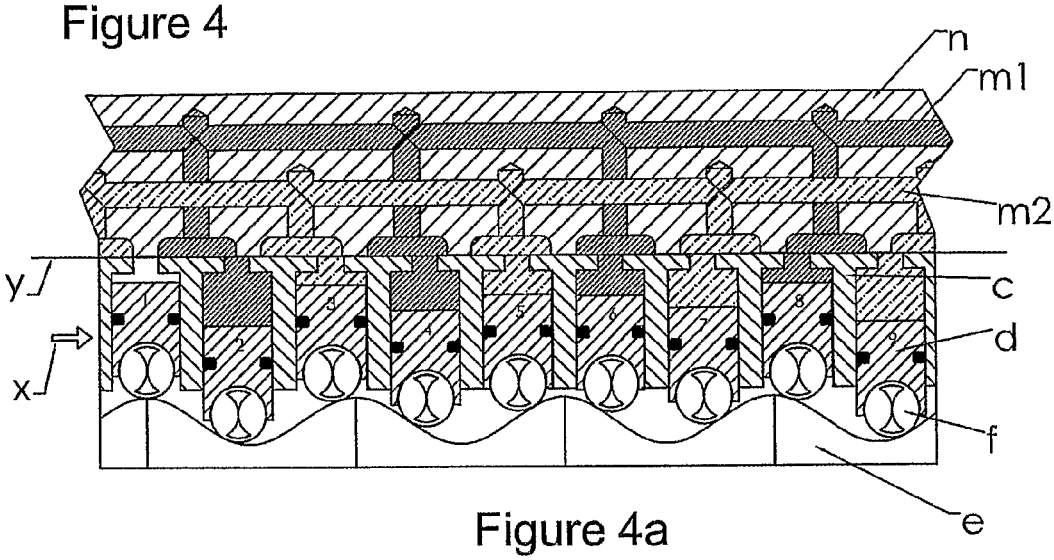
Figure 4a
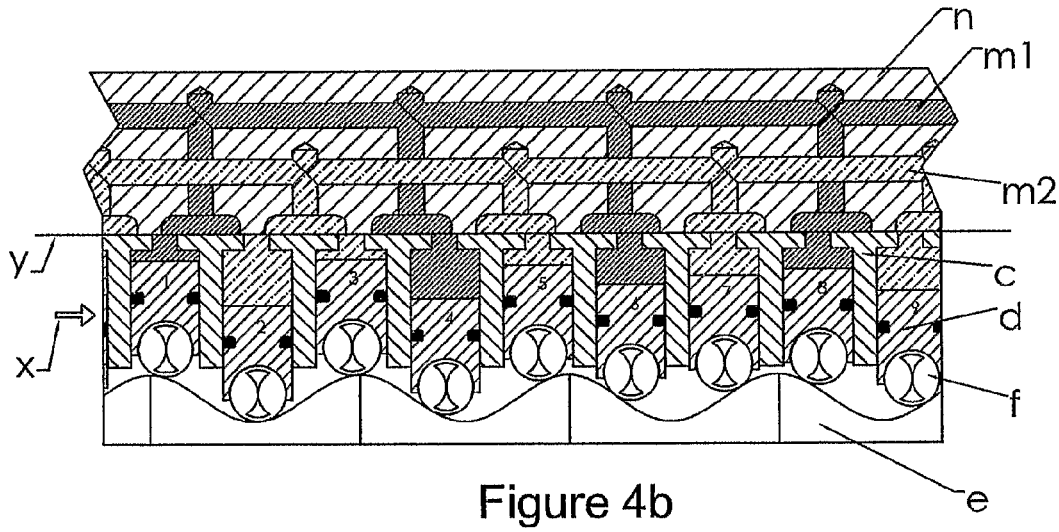
Figure 4b
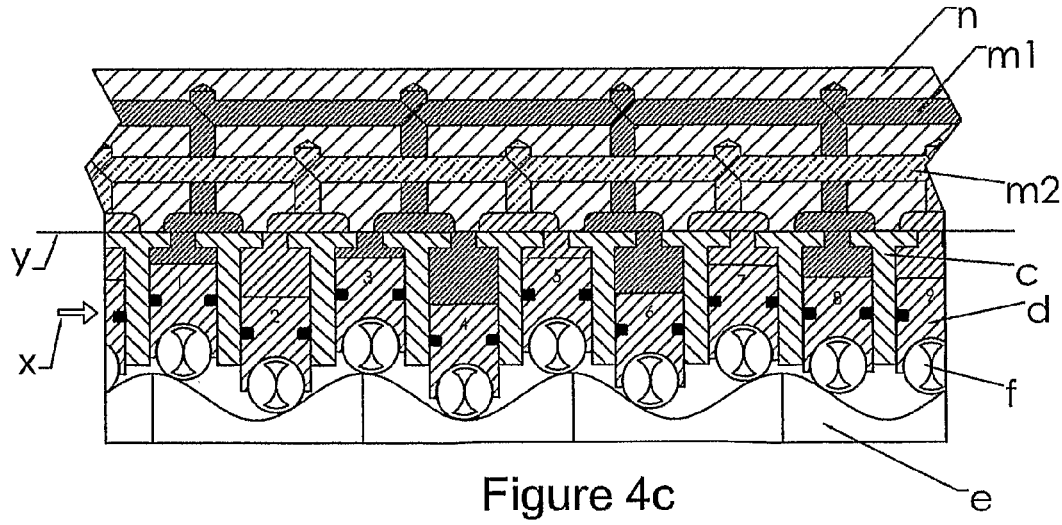
Figure 4c

FLUID POWERED MOTOR

RELATED/PRIORITY APPLICATION

This application is a National Phase filing regarding International Application No. PCT/GB2006/001659, filed on May 9, 2006. International Application No. PCT/GB2006/001659 relies upon British Application No. GB 0509787.8, filed on May 12, 2005, for priority.

FIELD OF THE INVENTION

This invention relates to a fluid powered motor with a common design concept, intended for low pressure (<20 bar) delivery of water and water based fluid(s).

BACKGROUND OF THE INVENTION

The food industry extensively employs small electric motors with grease filled speed reduction gearboxes, to drive conveyors etc. As hygiene and non-contamination is of high importance scheduled wash down of equipment is a standard procedure. Apart from shutting down production, electric motors etc must be covered, and at start-up removed. Sometimes, operatives omit to remove covers resulting in overheating, and possibly contamination of the food product being processed/handled.

OBJECT OF THE INVENTION

A basic object of the invention is to provide a low speed, high torque non-electric drive motor for the food industry obviating the need for, and drawbacks of prior art electric motors and associated gearboxes.

SUMMARY OF THE INVENTION

According to the present invention, there is provided a low pressure (up to 20 bar/294 psi) water and water based fluid-powered motor constructed from corrosion resistant materials comprising;

(i) a non-rotatable cover;

(ii) an undulating lobe cam track attached to the cover and defining multiple crests and troughs;

(iii) a rotatable cylinder block;

(iv) at least three reciprocating pistons each housed within a bore of the cylinder block and each providing at one end a crown (d1), and at the other end a spherical seating cup (d2);

(v) a ball (f), rotatable in each spherical seating cup (d2) and adapted to engage with the cam track;

(vi) a fluid seal (d3) between each piston and its associated bore;

(vii) ports (L1, L2) incorporated in the cylinder block to allow the passage of higher pressure fluid to, and lower pressure fluid from, the bores;

(viii) a non-rotatable manifold block (n) incorporating a plurality of ports (s), each being radially disposed at equal intervals in an end face of the manifold block adjacent the pistons, with the ports (s) linked to galleries connected to a higher fluid pressure delivery circuit, and a lower pressure return circuit, with the angular arrangement of the ports (s) being such that the higher fluid pressure is supplied to the crown of each piston only whilst the piston is moving from a crest to a trough of the cam track, with a switch to the lower fluid pressure circuit as continued rotation of the cylinder block moves a piston from a trough to a crest;

(ix) an output/input shaft (a) connected to the cylinder block; and (x) a rotary commutation, multi-ported face plate interposed between the cylinder block and the manifold block is mounted on the shaft and adapted to engage an adjacent end face of the manifold block or cylinder block under spring bias.

Thus, the higher fluid pressure applied to the pistons moving from crest to troughs produces a torque and hence rotation of the cylinder block, valve plate, and the output shaft.

Clearly, the use of multiple pistons in conjunction with the multi lobe cam track will produce a corresponding multiple of operating strokes per revolution.

As the motor in accordance with the invention is designed to operate at comparatively low hydraulic pressures, low cost, light weight, corrosion resistant plastics may be extensively used in manufacture.

The motor and pump is intended for safe operation in volatile and hygienically sensitive environments, typically in the food industry.

The fluid powered motor, is operable by water without any special additives, at relatively low pressures preferably around 10 bar to obtain a rotary output. As positive displacement principles are used in the motor design, other fluids (both gaseous and liquid) may be used.

PREFERRED OR OPTIONAL FEATURES OF THE INVENTION

The motor has symmetrical internal arrangement to give identical motor performance in either direction of rotation.

The cylinder block houses seven to ten pistons.

The cylinder block houses, seven, eight, nine or ten cylinders.

The face plate has at least one of its sealing faces able to pivot about its axis to compensate for angular misalignment between the faces.

The face plate has sealing elements automatically self adjusting for wear.

The face plate has radially disposed circular bores on one face that are connected to kidney shaped ports in the opposite face.

The efficiency of the motor is enhanced by minimising unbalanced radial forces acting on the cylinder block by the selection of the appropriate ratio of the number of cam lobes to number pistons forming the assembly.

Internal sliding interfaces are cooled by a controlled flow of the fluid medium through the internal mechanisms of the motor.

The cam track is produced from a polymer that is able to sustain, absorb and recover from the force on the balls generated by the associated pistons.

The cam track has four lobes for low speed.

The cam track has two lobes for high speed.

The cam track has two to six lobes.

The cam track profile is designed for constant speed throughout 360 degrees of rotation.

The cam track is designed for constant torque.

The cam track is a continuously sinusoidal cam track.

The manifold block incorporates eight ports.

A drain conduit is incorporated in the output shaft to conduct water away from the shaft bearing should the shaft seal fail Fluid connection is made by "push in" fittings that automatically grip plastics or metal supply and return pipes for the fluid medium.

The geometry of the components of the motor is such that the crown of each piston is isolated from the higher-pressure fluid circuit just before the piston reaches the bottom of a trough and is connected to the lower fluid pressure circuit just before the piston starts to climb from the bottom of the trough.

A bearing interface is provided between each ball and spherical seating cup.

The interface is of a polymer.

A plurality of 'O'-rings are carried by the manifold block to make sealing engagement with a portion of the internal periphery of the cover to maintain separation of the high pressure and the low pressure circuits.

The manifold block is axially displaceable and biased into sealing engagement of its end face with the face plate by a coil compression spring.

The manifold box is restrained from axial movement, and the face plate is spring biased either from the cylinder block or from the manifold block.

A non-return valve is incorporated in the high pressure and low pressure fluid circuits. Each of these two "check" valves is arranged to drain fluid from the internal region of the assembly to the low pressure exhaust pipe.

Associated with the ports of the manifold block are "kidney" shaped depressions formed in the face of the manifold block, angularly spaced around the face and separated by lands.

Each gallery connects with a groove formed in the outer periphery of the manifold block The galleries/grooves are arranged so that four of the ports at 90-degree intervals are linked to one of the grooves and the other set of four ports are linked at 90-degree intervals to the other channel.

Each of the ports is alternatively linked to one, and then the other, channel. This arrangement allows the motor to operate in both directions of rotation by simply switching the pressure feed and return lines, or reversing the flow of fluid e.g. water through the motor.

The cover retains the manifold block and creates an enclosure of the channels formed in the manifold block.

Seals are located either side of the channels to ensure that fluid within the channels is retained.

Two radial ports formed in the cover link the annular grooves in the manifold block with fluid "supply" and "return" pipes.

On the output shaft is mounted a rotary face "bellows" seal comprising of a coil compression spring to urge a rotating ring enclosed in a rubber gaiter into contact with a stationary ring mounted in a position to prevent the fluid from the interior of the motor coming into contact with the bearing.

A gallery system in the output shaft is formed in such a way as to drain fluid that may pass the rotary face "bellows" seal.

A bearing housing retains a double row, angular contact bearing, which supports the output shaft.

The cylinder block/shaft assembly forms a cartridge in which the forces developed by the pistons are contained by the shaft (in tension) and transferred to the bearing.

The cover is of a polymer resistant to abrasion and impact.

The interface between the manifold and faceplate forms a rotary face seal that is formed by fluid pressure inducing intimate contact of the two components. The relationship between the pressure forces in the manifold annulus urges the manifold into contact with the faceplate. The pressure forces in the kidney recesses urge the two components apart. The ratio between these forces is at a level that produces an effective seal at minimised friction levels. Because the seal is affected by the supply pressure, the ratios of balancing forces are maintained irrespective of varying supply pressures.

The balls are of a corrosion resistant material that provides good bearing characteristics i.e. glass, stainless steel, ceramics, silicates etc.

BRIEF DESCRIPTION OF THE DRAWINGS

The invention will now be described in greater detail, by way of example, with reference to the accompanying drawings, in which:

FIG. 4 show the circular form of the motor expressed in two dimensions and show three stages of the operating cycle of the motor;

DETAILED DESCRIPTION OF THE PREFERRED EMBODIMENT

Figure 1:
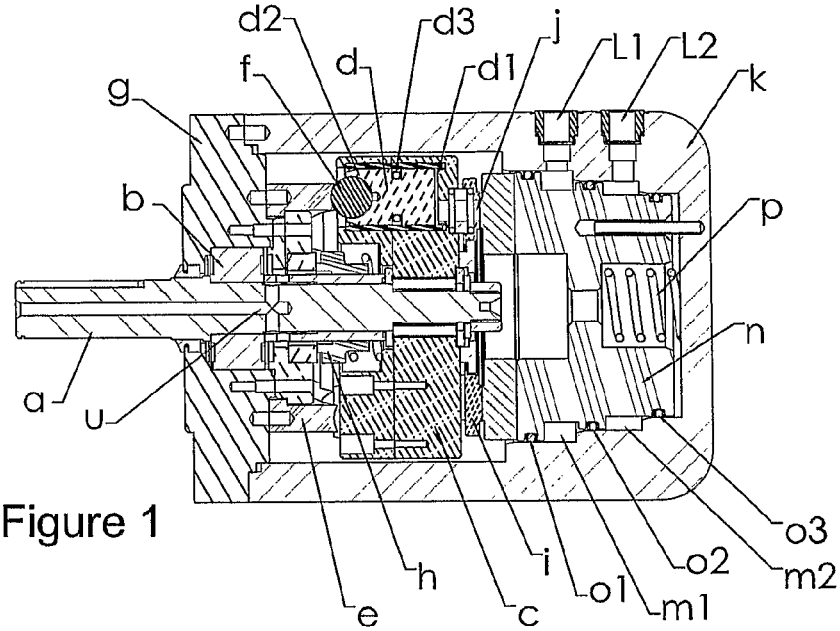
FIG. 1 is an axial sectional view through the motor.

Like reference numerals are used for like components in all Figures.

Figure 2:
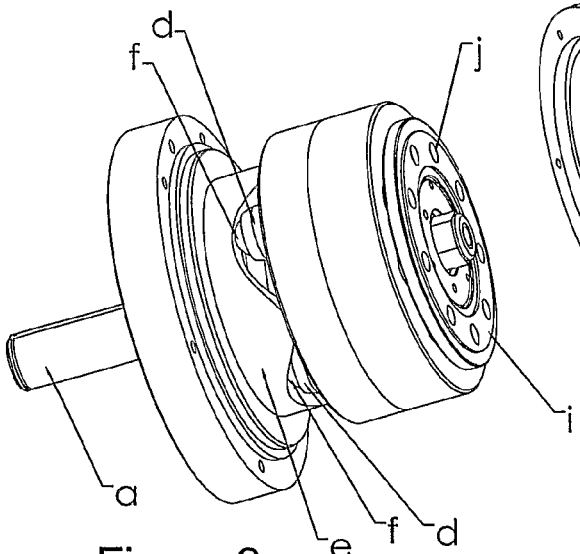
FIG. 2 is a view of the cylinder block and shaft assembly formed as a cartridge.
Figure 3:
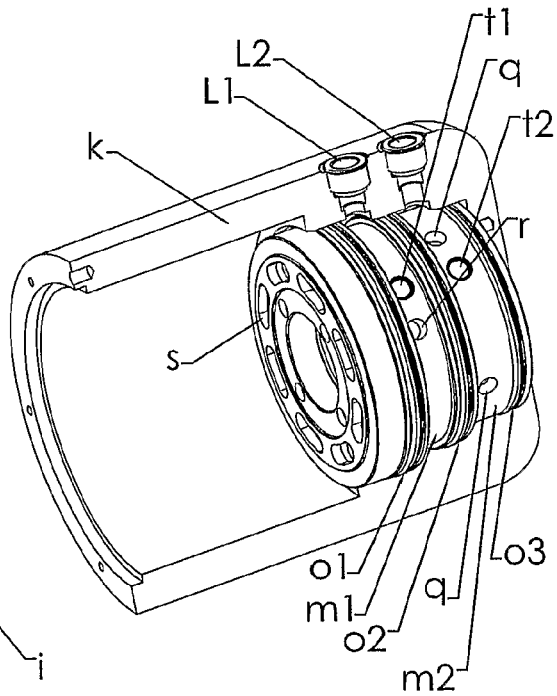
FIG. 3 is a view of the non-rotatable manifold block and an axial section view of the non-rotatable cover.
Figure 5:
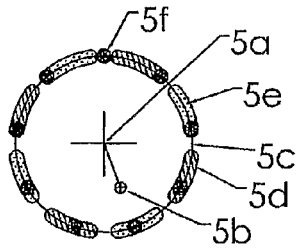
FIG. 5 demonstrates the moving force centroid developed by a nine piston four lobed cam arrangement and shows the sequential operating positions for a nine piston cylinder block running on a four-lobe cam in a sequence of 5 degree angular increments.
Figure 5:
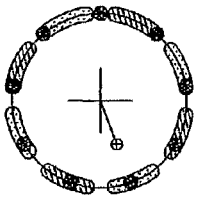
Figure 5:
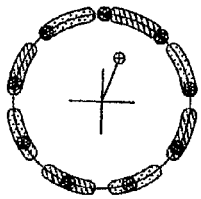
Figure 5:
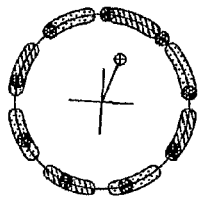
Figure 5:
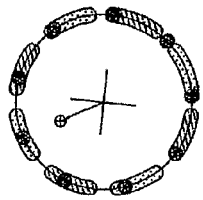
Figure 5:
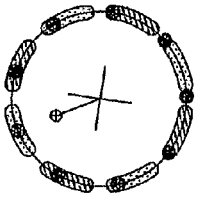
Figure 5:
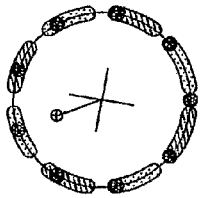
Figure 5:
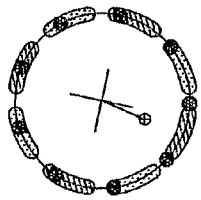
Figure 5:
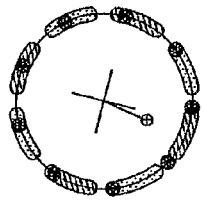
Figure 5:
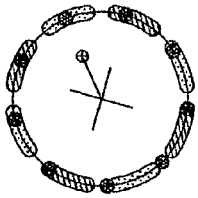
Figure 5:
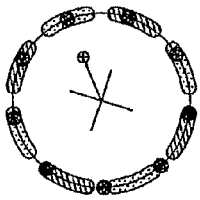
Figure 5:
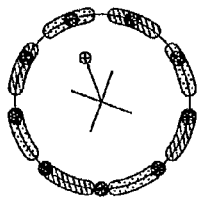
Figure 5:
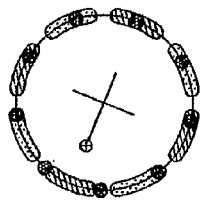
Figure 5:
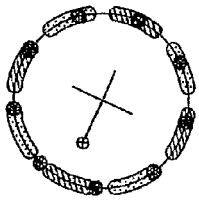
Figure 5:
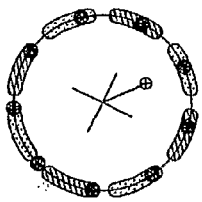
Figure 5:
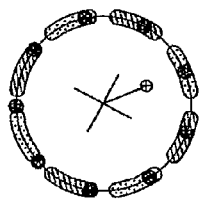
Figure 5:
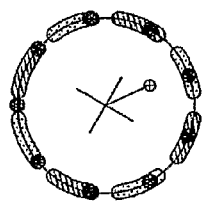

As can be seen in FIGS. 1 to 3 a shaft (a) is rigidly supported by a bearing (b) that is able to sustain radial and lateral loading. A cylinder block (c) is fixed to the shaft and is able to rotate about the shaft axis. The cylinder block (c) contains a plurality of bores equally spaced on a common pitch circle diameter (P.C.D.) concentric with the shaft axis. Each bore houses a reciprocating piston (d) and each piston (d) is provided at one end with a crown (d1) and at the other end with a spherical seating cup (d2), with a seal (d3) between each piston and the cylinder block. The pistons (d) are able to act on a cylindrical cam track (e) through balls (f) that are retained in the spherical seats of the pistons (d). The cam track (e) is engaged by the balls (f) and in which track the balls (f) are able to rotate. The P.C.D. of the cam track is concentric with the shaft axis and identical to the P.C.D of the pistons. The cam track (e) is fixed to a plate (g) that also retains the bearing (b). A radial seal (h) is attached to the shaft (a). A face plate (i) is fixed to cylinder block (c) which in turn is fixed to the shaft (a) and is able to rotate. The face plate (i) incorporates ports (j) connecting with the chambers associated with the piston crown and cylinder bore.

A non-rotatable cover (k) incorporates ports (L1) and (L2). The ports are linked to annular grooves (m1) and (m2) formed between the cover (k) and a manifold block (n). The manifold block (n) is free to slide axially in the cover (k) but is located radially within the cover, and the annular passages M1 and M2 of the manifold block (n) are sealed by 'O'-rings (o1) (o2) and (o3). A compression spring (p) is located in a counter bore in the manifold block (n) and engages the internal face of an end wall of the cover. Passages (q) and (r) link the annuli (m1) and (m2) to "kidney" shaped port (s) in a face of the manifold block (n). Non-return valves (t1) and (t2) allow fluid to pass from the interior of the manifold block (n) into the annuli.

The shaft (a) incorporates galleries (u) which connects with a chamber formed between seal (h) and bearing (u) to drain fluid that may pass seal (h).

The cover assembly illustrated in FIG. 3 is mounted on the plate (g), which incorporates a seal making the motor watertight. The face of the manifold block (n) is induced by spring (p) to engage with the faceplate (i) to form a seal between the two surfaces.

The operating sequences of the motor are shown in FIG. 4. Diagrams 4*a*, 4*b* and 4*c* show the commutation sequence of a motor with 9 pistons and a four lobed cam at three positions. The operating principles are similar for other combinations of numbers of pistons and cam lobes.

FIG. 4 Key:

n. manifold block
c. cylinder block
d. piston
f. piston ball
e. cam
m1 annular passage
m2 annular passage
y sliding interface
x direction of rotation.

The diagrams show cylinder block (c) moving in the direction of arrow (x). Manifold block (n) and cam (e) remain stationary. Fluid under pressure fills annular passages (m1) and low pressure fluid exhaust is expelled via annular passage (m2). An interface (y) is formed between (c) and (n) to maintain an effective fluid seal.

FIG. 4*a*—Position 1:

Piston 1 is at top dead centre of its stroke. Flow in and out of the cylinder is suspended as the port in the faceplate coincides with a land occurring between the kidney recesses in the manifold block.

Pistons 2,4,6 and 8 are on power strokes where each of the pistons is linked to a kidney recess connected to the pressure supply.

Pistons 3,5,7 and 9 are on return stroke and their associated faceplate ports are linked to kidney recesses connected to the exhaust passage.

FIG. 4*b*—Position 2:

Piston 1 is now connected with a supply pressure kidney recess and is on power stroke. Pistons 4,6 and 8 are also connected to pressure kidney recesses and are on power stroke.

Piston 2, which is now on its return stroke, shares the same kidney recess as piston 3, which is also on its return stroke. Pistons 5, 7 and 9 are also on their return strokes.

FIG. 4*c*—Position 3:

Pistons 1, 3, 4, 6 and 8 continue their power strokes. Piston 3 now shares the same kidney port recess as piston 4 and is at the start of a power stroke.

Pistons 2, 5, 7 and 9 continue on their return strokes.

Should annular passage m2 convey fluid pressure and annular passage (m1) convey exhaust fluid, cylinder block (c) will move in the opposite direction to that indicated by (x). Because the mechanical layout of the assembly is symmetrical, motor performance in either direction of rotation is identical.

FIG. 5. Key

5*a*. centre of shaft rotation
5*b*. force centroid
5*c*. pitch circle centre line
5*d*. pressure kidney port
5*e*. exhaust kidney port
5*f*. cylinder block port The sequences of motor commutation are shown in diagrams 5.1 to 5.16 during rotation in increments of two degrees. The diagrams show the cumulative reactive piston forces acting on the cylinder block parallel to the axis of the shaft relative to (5*a*) which is the centre of shaft rotation. Force centroid (5*b*) indicates the focus of the forces. The forces are generated by fluid pressure supplied through pressure kidney ports (5*d*) to the pistons at the appropriate period in the commutation sequence via cylinder block ports (5*f*). Low pressure exhaust fluid is expelled from the pistons via the cylinder block ports (5*f*) to the exhaust kidney ports (5*e*), at the appropriate commutation period, kidney ports (5*d*) and (5*e*) are on a common pitch circle centre line with cylinder block ports (5*f*).

The radial distance of (5*b*) from (5*a*) represents the magnitude of the turning force acting on the cylinder block and efficient operation of the motor is achieved when (5*b*) is within (5*c*). Certain ratio combinations of the number of pistons and cam lobes achieve this, amongst which are:

Pistons to Cam Lobes
9:4
9:2
8:6
7:4
10:4

Motor Operation

According to the desired direction of shaft rotation, either of the cover ports (L1) or (L2) is connected to a supply of pressure fluid. The remaining port L2 or L1 is connected to the flow return line. For this example, it will be assumed that port (L2) is connected to the pressure supply and (L1) is connected to the return line.

In this arrangement, pressurised fluid enters annulus (m2) and passages (q) resulting in an increase in pressure throughout the passage system. An increase in pressure in annulus (m2) cause the manifold (n) to behave like a piston and move forward into contact with the faceplate (i). The pressure force in (m2) supplements the force generated by the spring (p) to create a seal in the interface between the manifold and the faceplate (i).

The function of the spring (p) is to provide initial contact between the faces and minimise pressure decay through leakage between the faces of the manifold and faceplate during the motor starting sequence.

Once the faces of the manifold and faceplate are in contact, fluid is able to flow through passage (q) to fill the associated kidney recesses formed in the face of the manifold.

Flow from the kidney recesses flow through ports (j) into the "pressure" chambers of the appropriate pistons formed by the piston crown and enclosing bore.

The linear force developed by the pistons is converted to rotary force by the piston ball acting on the cam lobes.

On the return stroke of the piston, the exhaust fluid follows a similar path through the system but flows from the piston chambers via ports (j) and through kidney recesses associated with passages (r) at appropriate periods in the motors commutation. The exhaust fluid enters annulus (m1) and exits through cover port (L1).

If the direction of fluid flow is reversed, the motor operates in the opposite direction.

The motor is designed to operate in a "flooded" condition in which pre-defined levels of leakage from the face seal will fill the internal spaces within the cover and bearing plate.

When the water pressure in the cover reaches a predetermined level, the pressure will be relieved through either one of the check valves (11) or (12) that is at the time connected to the low-pressure annulus.

The passage of water through the system conducts heat away from internal bearing interfaces.

Figure 6:
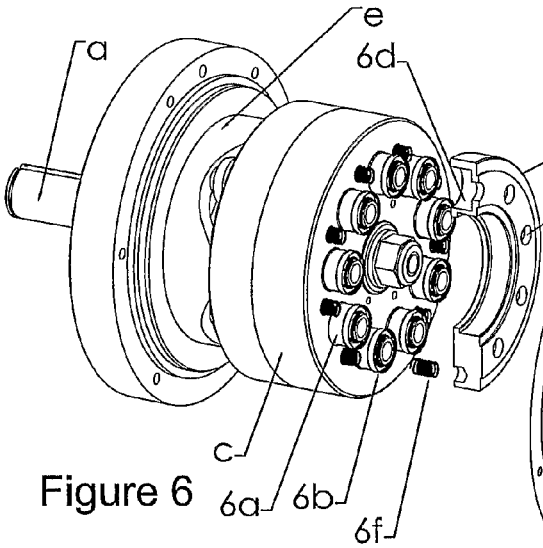
FIGS. 6 and 7 show a second embodiment.
Figure 7:
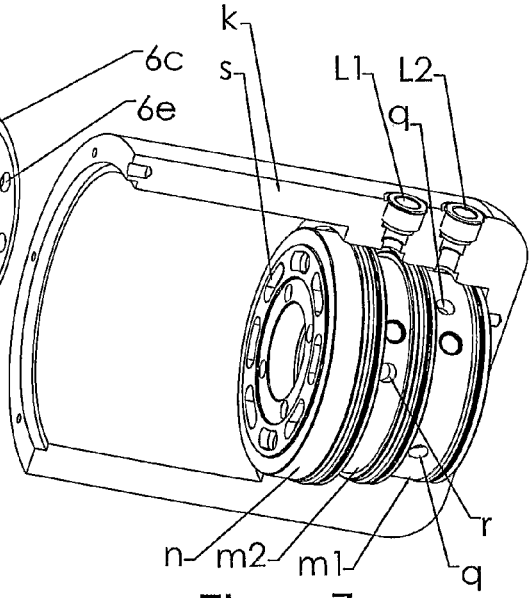

In the embodiment of FIGS. 6 and 7, the manifold block is restrained from axial and radial movement within the cover housing, FIG. 6 showing spring bias of the face plate from the cylinder block, and FIG. 7 showing spring bias of the face plate from the manifold block. In both FIGS. 6 and 7 a plurality of circular extrusions radially disposed on the face the manifold block incorporate ports linked to the fluid supply and exhaust circuits.

The manifold plate incorporates radially disposed cylinder bores that engage with the circular extrusions in the manifold block to form a plurality of piston/cylinder arrangements.

A plurality of radial seals are associated with the engagement of the circular extrusions and manifold plate bores to form a pressure tight region in the manifold plate bores.

The manifold plate is restrained from rotational angular movement by the engagement bore of the manifold plate with piston extrusions.

The manifold plate is able to pivot about its centre line in a plane perpendicular to the centre line within the constraints of the sealing arrangement between the manifold plate cylinder bores with the manifold piston extrusions.

The manifold plate is able to move axially along the several axes of the multiple piston/cylinder arrangements within the constraints of the arrangement for sealing between the engagement of the manifold plate cylinder bores with the manifold piston extrusions.

A plurality of pressure tight regions are formed In the manifold plate cylinder bores by the radial seals in conjunction with the manifold face extrusions.

As shown in FIGS. 6 and 7, cylindrical extrusions (6*a*) are formed on the face of the cylinder block (c). Ports formed in the circular face of the extrusions are linked to the motor pistons which engage with the cam (e).

The cylindrical extrusions (6*a*) incorporate radial seals (6*b*) which engage with bores (6*d*) formed in an adjacent face of the face plate (6*c*). The cylindrical extrusions (6*a*) form dowels that engage the bores (6*d*).

The opposite face of the face plate (6*c*) is urged into contact with the adjacent face of the manifold block (n) shown in FIG. 3, by compression springs (6*f*). The spring force is sufficient to facilitate initial engagement of the faces which is subsequently supplemented by fluid pressure forces.

Operation of the Motor of FIGS. 6 and 7

In the static condition of the motor, one face of face plate (6*c*) is urged into contact with the adjacent face of the manifold block (n) by the force of springs (6*f*).

According to the desired direction of shaft rotation, either of the cover ports (L1) or (L2) is connected to the pressure supply. The remaining port is connected to the flow return line. For this example, it will be assumed that port (L2) is connected to the pressure supply and (L1) is connected to the return line.

In this arrangement, pressurised fluid enters annulus (m2) and passages (q) resulting in an increase in pressure throughout the passage system.

An increase in pressure in annulus (m2) is transmitted to the appropriate kidney recesses (s) which connect with the ports (6*e*) in the cylinder face plate to act upon the appropriate motor pistons (d).

The linear force developed by the pistons is converted to rotary force by the piston ball acting on the cam lobes.

Simultaneously, each of the associated cylinder/piston arrangements formed by cylinder block extrusions (6*a*), seals (6*b*) and cylinders (6*d*) in the cylinder face plate (6*c*) are exposed to pressure that urges the cylinder face plate into contact with the face of the manifold block (n).

The pressure force urging the cylinder face plate into contact with the manifold supplements the force generated by the springs (6*f*) to create a sealing interface.

On the return stroke of the piston, the exhaust fluid follows a similar path through the system but flows from the piston chambers via ports (6*e*) and through kidney recesses (s) that are associated with passages (r) at appropriate periods in the motors commutation. The exhaust fluid enters annulus (m1) and exits through cover port (L1).

Figure 8:
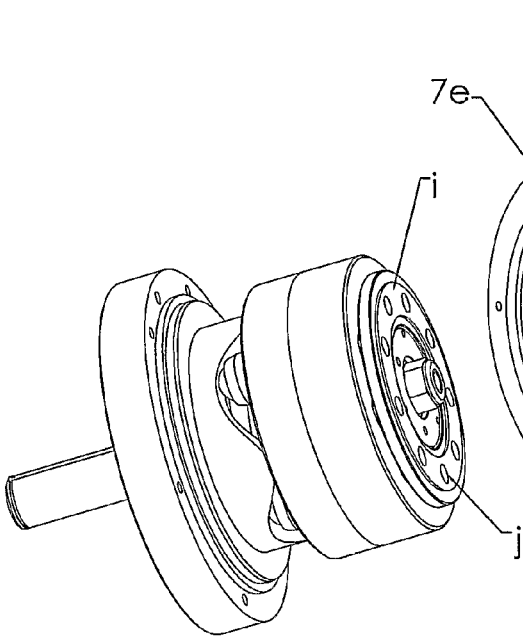
FIGS. 8 and 9 show a third embodiment.
Figure 9:
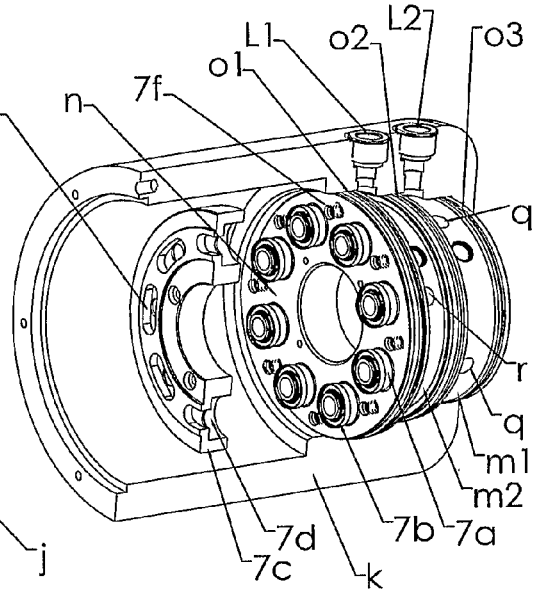

In the embodiment of FIGS. 8 and 9, cover (k) and manifold plate (7*c*) is shown in section on a plane perpendicular to the centre line through the assembly.

The manifold block (n) is restrained from moving both axially and rotationally within the cover (k) and incorporates a series of circular extrusions or "bosses" (7*a*) extruded from the face of the manifold block adjacent to the cylinder port plate (i) in FIG. 2.

The cylindrical extrusions incorporate radial seals (7*b*) which engage with bores (7*d*) formed in the rear face of the manifold plate (7*c*) to form a piston/cylinder arrangement.

The manifold plate bores are linked by ports to "kidney" shaped recesses (7*e*) formed in the opposite face of the manifold plate. The kidney depressions are angularly spaced around the face of the manifold plate and separated by lands.

The face of manifold plate (7*c*) is biased into engagement with the cylinder block plate (i) by a plurality of coil compression springs. The spring force is sufficient to facilitate initial engagement of the faces which is subsequently supplemented by fluid pressure forces.

Operation of the Embodiment of FIGS. 8 and 9

According to the desired direction of shaft rotation, either of the cover ports (L1) or (L2) is connected to the pressure supply. The remaining port is connected to the flow return line. For this example, it will be assumed that port (L2) is connected to the pressure supply and (L1) is connected to the return line.

In this arrangement, pressurised fluid enters annulus (m2) and passages (q) resulting in an increase in pressure throughout the passage system.

An increase in pressure in annulus (m2) is transmitted to each of the associated cylinder and piston arrangements formed by cylindrical extrusions (7*a*), seals (7*b*) and cylinders (7*d*) cause the manifold plate (7*c*) to move forward into contact with the faceplate (i). As an intimate interface has been accomplished by spring force, the pressure force now generated in manifold plate bores (7*d*) supplements the force generated by the springs (7*f*) to create a seal in the interface between the manifold plate and the cylinder block faceplate.

The pressure induced interface allows fluid to flow from the kidney recesses through ports (j) into the "compression" chambers of the appropriate pistons.

On the return stroke of the piston, the exhaust fluid follows a similar path through the system but flows from the piston chambers via ports (j) and through kidney recesses (7*e*) associated with passages (r) at appropriate periods in the motors commutation. The exhaust fluid enters annulus (m1) and exits through cover port (L1).

The invention claimed is:

1. A low pressure, water or water based fluid powered motor constructed from corrosion resistant material, comprising (i) a non-rotatable cover (k);

(ii) a cylinder block (c) housed within said non-rotatable cover (k), wherein the cylinder block (c) is rotatable;

(iii) a plurality of bores provided with said cylinder block (c);

(iv) a plurality of reciprocating pistons (d), each of the plurality of reciprocating pistons is housed within a respective bore of said plurality of bores of said cylinder block (c) and is provided at one end a crown (d1), and at an other end a spherical seating cup (d2);

(v) a ball (f), rotatable in each of said spherical seating cups (d2);

(vi) ports (L1, L2) incorporated in said non-rotatable cover (k) to allow the passage of a higher pressure fluid to, and a lower pressure fluid from, said plurality of bores;

(vii) a non-rotatable manifold block (n) incorporating a plurality of manifold ports (s), each of said plurality of manifold ports is radially disposed at equal intervals in a non-rotatable manifold block end face and adjacent said plurality of reciprocating pistons (d), said plurality of manifold ports (s) are linked to galleries connected to a higher pressure fluid delivery circuit and a lower pressure fluid return circuit, wherein grooves (m1, m2) are provided between the non-rotatable cover (k) and the non-rotatable manifold block (n), wherein passages (q, r) are provided in the non-rotatable manifold block (11), and wherein the grooves (m1, m2) and the passages (q, r) provide a fluid path from the ports (L1, L2) in the non-rotatable cover (k) to the plurality of manifold ports (s);

(viii) an output/input shaft (a) connected to said cylinder block (c);

(ix) a rotary commutation multi-ported face plate (i) interposed between said cylinder block (c) and said non-rotatable manifold block (n), mounted on said output/input shaft (a), and adapted to engage one of said non-rotatable manifold block end face and a cylinder block end face under spring bias;

(x) an undulating lobe cam track (e), having two to six lobes, is attached to said non-rotatable cover (k) and defines multiple crests and troughs; and (xi) each ball (f) is adapted to engage with said undulating lobe cam track (e), characterized in that (a) (a) a fluid seal (d3) is carried by each of the plurality of reciprocating pistons (d) to sealingly engage respective bores of the plurality of bores;

(b) said cylinder block (c) houses seven to ten reciprocating pistons (d) that comprise the plurality of pistons (d); and (c) the angular arrangements of the plurality of manifold port (s) in the non-rotatable manifold block (n) and the ports (L1, L2) in the non-rotatable cover (k) are such that the higher pressure fluid is supplied to said crown (d1) of each the plurality of reciprocating piston (d) only when each of the plurality of reciprocating pistons (d) is moving from at least one crest to at least one trough of said undulating lobe cam track (e), wherein a flow of fluid within each of the plurality of bores is switched to supply the lower pressure fluid to said lower pressure fluid return circuit as continued rotation of said cylinder block (c) moves a each of the plurality of reciprocating pistons (d) from at least one trough to at least one crest of the undulating lobe cam track (e).

2. A fluid powered motor as claimed in claim 1, wherein said motor has a symmetrical internal arrangement to give identical motor performance in either direction of rotation.

3. A fluid powered motor as claimed in claim 1, wherein said cylinder block (c) houses seven, eight, nine or ten of said bores that comprise the plurality of bores.

4. A fluid powered motor as claimed in claim 1, wherein the rotary commutation multi-ported face plate (i) has at least one sealing face able to pivot about an axis to compensate for angular misalignment between the non-rotatable manifold block end face and the at least one sealing face of the rotary commutation multi-port face plate.

5. A fluid powered motor as claimed in claim 1, wherein the rotary commutation multi-ported face plate (i) has sealing elements automatically self adjusting for wear.

6. A fluid powered motor as claimed in claim 1, wherein the rotary commutation multi-ported face plate (i) has one face provided with radially disposed circular bores that are connected to the manifold ports (s), wherein the manifold ports are kidney shaped ports (s) provided in the non-rotatable manifold block end face opposite to the one face of the rotary commutation multi-port face plate.

7. A fluid powered motor as claimed in claim 1, wherein said undulating lobe cam track (e) is produced from a polymer that is able to sustain, absorb and recover from the force on the balls (f) generated by the plurality of reciprocating pistons (d).

8. A fluid powered motor as claimed in claim 1, wherein said undulating lobe cam track (e) is a continuously sinusoidal cam track.

9. A fluid powered motor as claimed in claim 1, wherein said non-rotatable manifold block (n) incorporates eight manifold ports (s) that comprise the plurality of manifold ports (s).

10. A fluid powered motor as claimed in claim 1, wherein a plurality of '0'-rings (o1, o2, o3) are carried by said non-rotatable manifold block (n) to make sealing engagement with a portion of an internal periphery of said non-rotatable cover (k) to maintain separation of said higher pressure fluid delivery and lower pressure fluid return circuits.

11. A fluid powered motor as claimed in claim 1, wherein said non-rotatable manifold block (n) is axially displaceable and biased by a coil compression spring such that the non-rotatable manifold block end face is in sealing engagement with the rotary commutation multi-ported face plate (i).

12. A fluid powered motor as claimed in claim 1, wherein said non-rotatable manifold block (n) is restrained from axial movement, and the rotary commutation multi-ported face plate (i) is spring biased by an engagement with one of said cylinder block (c) and said non-rotatable manifold block (n).

13. A fluid powered motor as claimed in claim 1, wherein said manifold port (s) of said non-rotatable manifold block (n) are "kidney" shaped ports (s) formed in the non-rotatable manifold block end face that is held in abutment with the rotary commutation multi-ported face plate (i), wherein the manifold ports (s) are angularly spaced around said manifold block end face and separated by lands.

14. A fluid powered motor as claimed in claim 1, wherein each of said galleries connects with the grooves (m1, m2), wherein the grooves (m1, m2) are formed in an outer periphery of said non-rotatable manifold block (n).

15. A fluid powered motor as claimed in claim 1, wherein fluid connection is made by "push in" fittings that automatically grip plastics or metal supply and return pipes for the fluid medium.

16. A fluid powered motor as claimed in claim 1, wherein a non-return valve is incorporated in both the said higher pressure fluid delivery and lower pressure fluid return circuits.

* * * * *